US006690335B2

(12) United States Patent
Onishi et al.

(10) Patent No.: US 6,690,335 B2
(45) Date of Patent: Feb. 10, 2004

(54) EXCELLENT WATERPROOF ANTENNA

(75) Inventors: Tadaaki Onishi, Fukushima-ken (JP); Hirotoshi Maegawa, Nara-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/131,897

(22) Filed: Apr. 25, 2002

(65) Prior Publication Data

US 2002/0158809 A1 Oct. 31, 2002

(30) Foreign Application Priority Data

Apr. 25, 2001 (JP) ..... 2001-127586

(51) Int. Cl.[7] ..... H01Q 1/32
(52) U.S. Cl. ..... 343/872; 343/713
(58) Field of Search ..... 343/872, 713, 343/700 MS, 711, 873, 712, 716

(56) References Cited

U.S. PATENT DOCUMENTS 5,563,378 A * 10/1996 Uchida et al. ..... 174/135
5,670,745 A 9/1997 Yajima et al. ..... 174/65 R

FOREIGN PATENT DOCUMENTS

| | | |
|---|---|---|
| JP | 6-140824 | 5/1994 |
| JP | 8 148916 | 6/1996 |
| JP | 8-148932 | 6/1996 |

* cited by examiner

*Primary Examiner*—James Clinger
(74) *Attorney, Agent, or Firm*—Brinks Hofer Gilson & Lione

(57) ABSTRACT

In the waterproof structure of an antenna of the present invention, a width of an open end top of a second notch provided on a projection of a second case is formed so as to be wider than a diameter of a cable, the cable that crosses a recess of a first case is placed in a first notch, and the projection that projects into the recess allows an adhesive to penetrate in the second notch and the adhesive seals a space between the cable and the second notch to thereby seal containers. As the result, a space between a top half of the cable and the second notch is sealed securely with the adhesive, the containers are sealed securely, and reliable waterproofing is realized.

3 Claims, 5 Drawing Sheets

EXCELLENT WATERPROOF ANTENNA

BACKGROUND OF THE INVENTION

1. Field of the Invention

This invention relates to a waterproof structure of an antenna used favorably for GPS (global positioning system) receiving antennas that are mounted on the outdoor of moving objects such as ships and automobiles.

2. Description of the Related Art

The conventional waterproof structure of an antenna will be described with reference to FIG. 10 to FIG. 13. A first case 51 comprising a mold product consisting of synthetic resin that is served as an under case is provided with a flat plate bottom wall 51*a,* two ring projection walls 51*b* that are different in diameter and project upward from the bottom wall 51*a,* a circular ring recess 51*c* formed between the two projection walls 51*b,* and a pair of first notches 51*d* formed on the two projection walls 51*b* so as to be positioned opposingly each other with interposition of the recess 51*c.*

Furthermore, the first case 51 comprises an arc recess holder 51*e* formed at the position so as to oppose to the first notch 51*d,* a plurality of mounting holes 51*f* formed on the bottom wall 51*a,* and a recess container 51*g* positioned at the center of the projection walls 51*b.*

An adhesive 52 is filled in the recess 51*c* and contained in the recess 51*c.*

An antenna 53 comprises an antenna body 54 and a coaxial cable 58, and the antenna body 54 comprises a rectangular parallelepiped antenna 55, a printed board 56 having a wiring pattern (not shown in the drawing) for attaching the antenna 55, and a box shield member 57 formed of a metal plate mounted on the printed board 56.

Furthermore, the circular cable 58 comprises a sheath 60 for sheathing a core wire 59 consisting of insulating material such as rubber, and a winding 61 that is wound partially on the sheath 60 consisting of insulating material, and the core wire 59 of the cable 58 is connected to the wiring pattern of the printed board 56 by means of soldering.

The antenna body 54 of the antenna 53 having the structure as described hereinabove is contained in the container 51*g,* the cable 58 is placed in the first notch 51*d* so as to cross the recess 51*c,* and the winding 61 is positioned on the holder 51*e.*

The width of the first notch 51*d* is formed so as to be approximately equal to the diameter of the cable 58. As the result, when the cable 58 is inserted into the first notch 51*d,* the sheath 60 of the cable 58 is inserted into with pressure and tightly compressed on the inside of the first notch 51*d* and the sheath 60 of the cable 58 is in tight contact with the bottom of the first notch 51*d.*

Furthermore, when the cable 58 has inserted with pressure into the first notch 51*d,* the bottom of the cable 58 is positioned in the adhesive 52 contained in the recess 51*c,* and around the bottom half of the cable 58, the space between the first notch 51*d* and the cable 58 is sealed with the adhesive 52 and the bottom half of the cable 58 is sealed by pressing the sheath 60 of the cable 58 with pressure on the inside wall of the first notch 51*d.* Thereby, the container 51*g* is sealed on the lead-out side of the cable 58 of the first case 51 side.

A second case 62 comprising a mold product consisting of synthetic resin that is served as a upper case comprises a bowl-shaped top wall 62*a* having the same peripheral configuration as that of the bottom wall 51*a*, a circular ring projection 62*b* that projects downward from the top wall 62*a,* a second notch 62*c* formed on the projection 62*b* having the same width as that of the first notch 51*d* that is positioned so as to oppose to the first notch 51*d,* a circular recess holder 62*d* formed at the position so as to oppose to the second notch 62*c,* a plurality of mounting holes 62*e* formed on the top wall 62*a* at the positions opposing to the mounting holes 51*f*, and a recess container 62*f* positioned at the center of the projection 62*b.*

The second case 62 is fitted combinedly to the first case 51 so as to cover over the antenna body 54, and a plurality of screws 63 are inserted and screwed from the mounting holes 51*f* side of the first case 51 into the mounting holes 62*e* of the second case 62 to thereby combine the first case 51 to the second case 62.

When the first and second cases 51 and 62 are combined, the winding 61 of the sheath 60 of the cable 58 is held with the holders 51*e* and 62*d,* the projection 62*b* is inserted into the recess 51*c,* and the top end of the projection 62*b* is embedded into the adhesive 52.

Furthermore, at that time, the cable 58 is positioned in the second notch 62*c,* the top of the second notch 62*c* presses the sheath 60 onto the first notch 51*d* side, the sheath 60 is inserted with pressure into and tightly pressed on the inside wall of the second notch 62. Thereby, the container 62*f* is sealed on the lead-out side of the cable 58 of the second case 62 side.

In other words, on the lead-out side of the cable 58 of the first and second cases 51 and 62, by inserting with pressure into and tightly pressing the cable 58 on the first and second notches 51*d* and 62*c,* the containers 51*g* and 62*f* are sealed, and by embedding the projection 62*b* in the adhesive 52, the surrounding of the container 51*g* and 62*f* is sealed. As the result, the antenna body 54 is waterproofed.

Next, a method for combining the first and second cases 51 and 62 will be described with reference to FIG. 13. As shown in FIG. 13, the second case 62 covers the first case 51 so that the second notch 62*c* is fitted to the cable 58 in the state that the cable 58 has been inserted with pressure into the first notch 51*d* of the first case 51.

As the result, at first, the inside wall that is opposing to the second notch 62*c* is brought into contact with the sheath 60, and when the second case 62 is moved downward further in this state, the top end of the projection 62*b* is embedded in the adhesive 52.

The surface of the adhesive 52 moves upward concomitantly with embedding of the projection 62*b,* the top of the second notch 62*c* presses the sheath 60 of the cable 58, the sheath 60 is pressed on the bottom of the first notch 51*d,* and the combination of the first and second cases 51 and 62 is completed.

However, though the surface of the adhesive 52 moves upward concomitantly with embedding of the projection 62*b* when these cases 51 and 62 are combined, because the width of the second notch 62*c* is formed so as to be approximately equal to the diameter of the cable 58, there is no space between the second notch 62*c* and the top open portion of the cable 58. As the result, the adhesive 52 does not penetrate into the space between the second notch 62*c* and the cable 58 though the surface of the adhesive moves upward, and no penetration of the adhesive 52 results in poor sealing between the second notch 62*c* and the cable 58 and the results in poor waterproofing of the containers 51*g* and 62*f.*

In particular, variation of contact tightness between the second notch 62*c* and the cable 52 due to variation of the width of the second notch 62*c* caused when the second case 62 is fabricated or variation of the diameter of the cable 58 or a slight space between the second notch 62*c* and the cable 52 results in poor sealing and further results in poor waterproof of the containers 51*g* and 62*f*.

There is no space between the second notch 62*c* and the open end top of the cable 58 because the width of the second notch 62*c* is formed so as to be approximately equal to the diameter of the cable 58 in the case of the waterproof structure of the conventional antenna. As the result, the adhesive 52 does not penetrate into the space between the second notch 62*c* and the cable 58, and no penetration of the adhesive 52 results in poor sealing between the second notch 62*c* and the cable 58 and results in poor waterproofing of the containers 51*g* and 62*f*.

In particular, variation of contact tightness between the second notch 62*c* and the cable 52 due to variation of the width of the second notch 62*c* caused when the second case 62 is fabricated or variation of the diameter of the cable 58 or a slight space between the second notch 62*c* and the cable 52 results in poor sealing and further results in poor waterproofing of the containers 51*g* and 62*f*. The poor waterproofing causes a problem.

SUMMARY OF THE INVENTION

In view of the above, the object of the present invention is to provide an inexpensive reliable waterproof structure of an antenna.

To solve the abovementioned problem, the first solution means has the structure provided with first and second cases, an antenna body contained in containers comprising the first and second cases, and a cable that is lead to the outside of the first and second cases, wherein the first cases has a recess for containing adhesive and a first notch for placing the cable that is disposed so as to cross the recess, the second case has a projection that projects into the recess and a second notch disposed on the projection that is positioned so as to oppose to the first notch for positioning the cable, a width of an open end top of the second notch is formed so as to be wider than a diameter of the cable, the cable that crosses the recess is placed in the first notch, and the projection that projects into the recess allows the adhesive to penetrate into the second notch to thereby seal a space between the cable and the second notch and to thereby seal the containers.

The second solution means has the structure in which a width of the first notch is formed so as to be approximately equal to the diameter of the cable.

Furthermore, the third solution means has the structure in which the recess is formed in ring-shape, the projection is formed in ring-shape, a top end of the projection excepting a portion positioned at the second notch is embedded in the adhesive and the containers are sealed thereby.

Furthermore, the fourth solution means has the structure in which the cable is positioned at a top of the second notch, and the space between the second notch including the top and the cable is sealed with the adhesive.

Furthermore, the fifth solution means has the structure in which the second notch is provided with an inclination formed so that a width of the second notch becomes wider from the top toward the open end top.

DETAILED DESCRIPTION OF THE PREFERRED EMBODIMENTS

Figure 1:
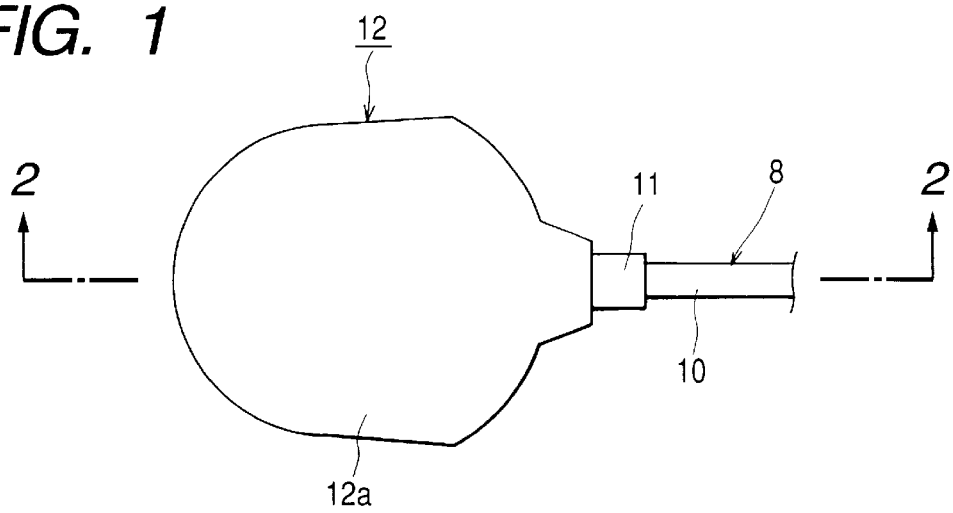
FIG. 1 is a plan view showing the waterproof structure of an antenna in accordance with the present invention.
Figure 2:
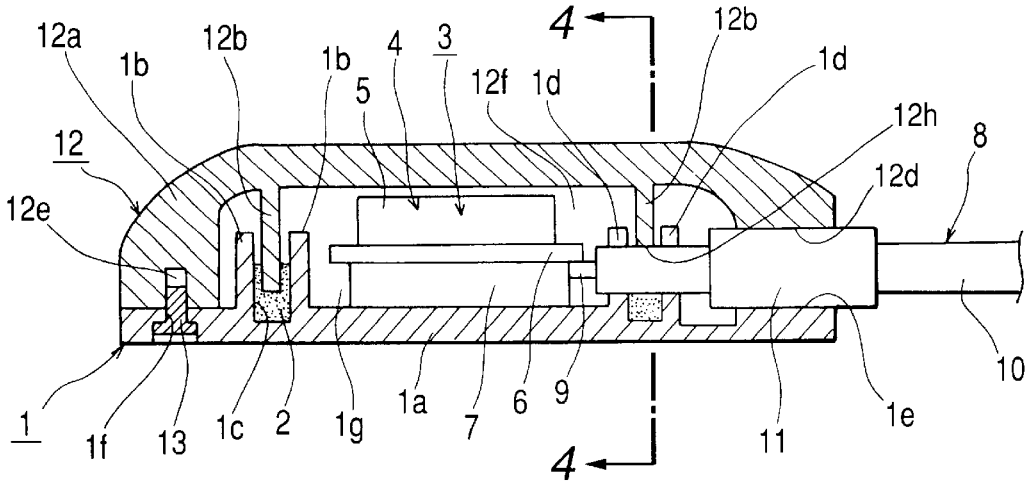
FIG. 2 is a partial cross sectional view along the line 2—2 of FIG. 1.
Figure 3:
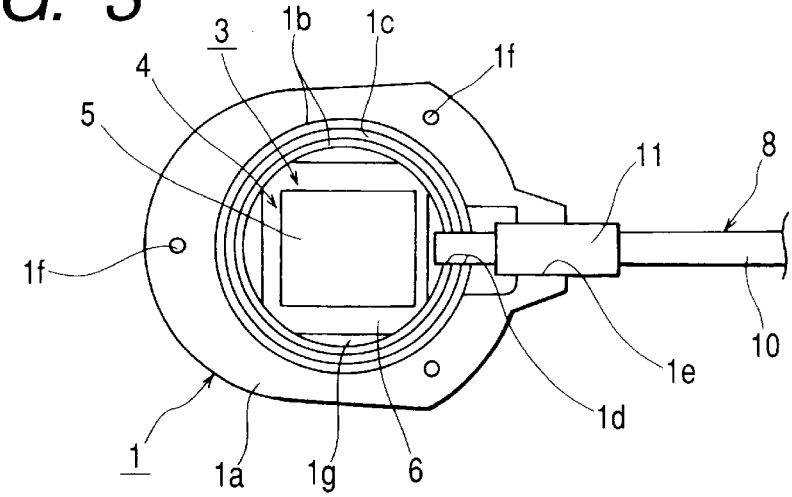
FIG. 3 is a plan view showing the waterproof structure of the antenna of the present invention from which a second case is removed.
Figure 4:
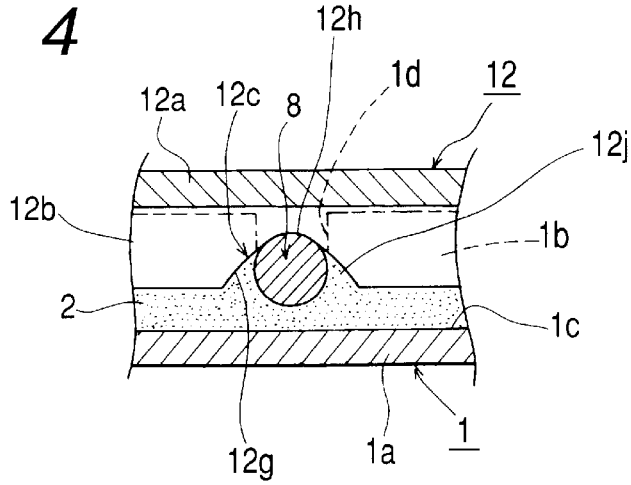
FIG. 4 is a partial cross sectional view along the line 4—4 of FIG. 2.
Figure 5:
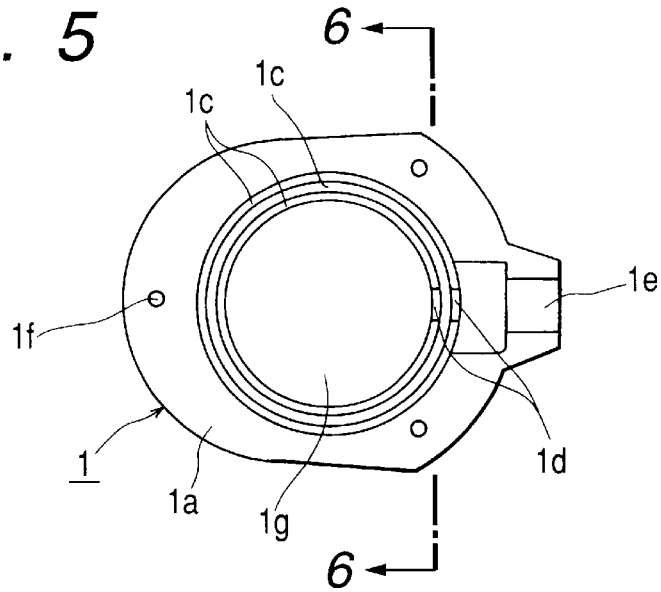
FIG. 5 is a plan view of a first case in accordance with the waterproof structure of the antenna of the present invention.
Figure 6:
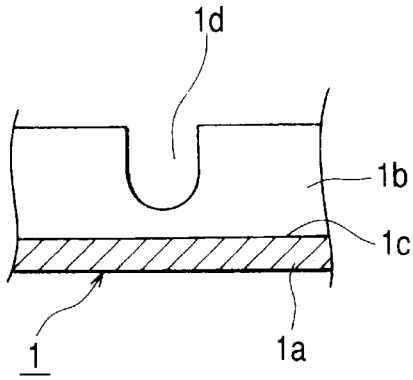
FIG. 6 is a partial cross sectional view along the line 6—6 of FIG. 5.
Figure 7:
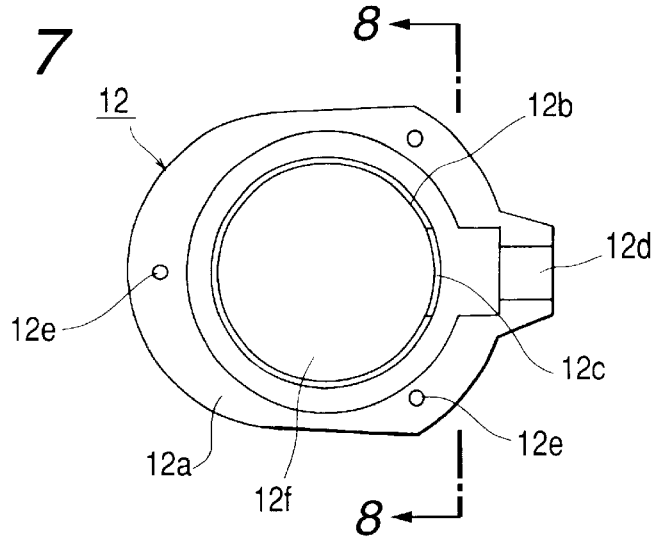
FIG. 7 is a bottom view of the second case in accordance with the waterproof structure of the antenna of the present invention.
Figure 8:
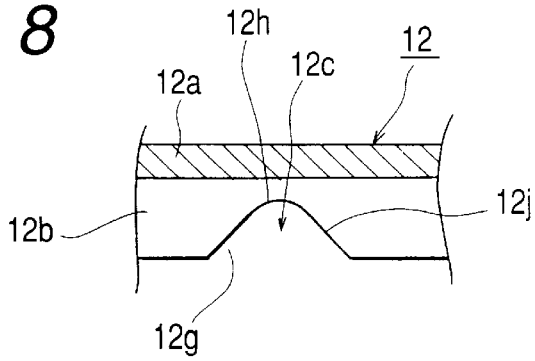
FIG. 8 is a partial cross sectional view along the line 8—8 of FIG. 7.
Figure 9:
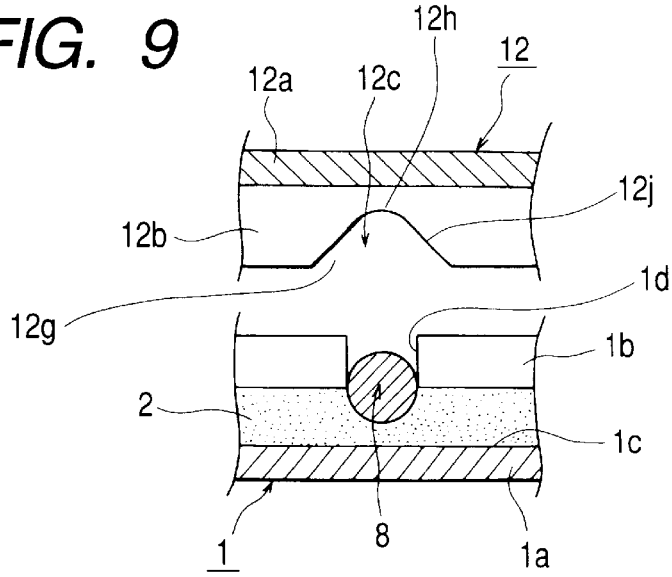
FIG. 9 is an explanatory diagram showing a combination of the first and second cases in accordance with the waterproof structure of the antenna of the present invention.
Figure 10:
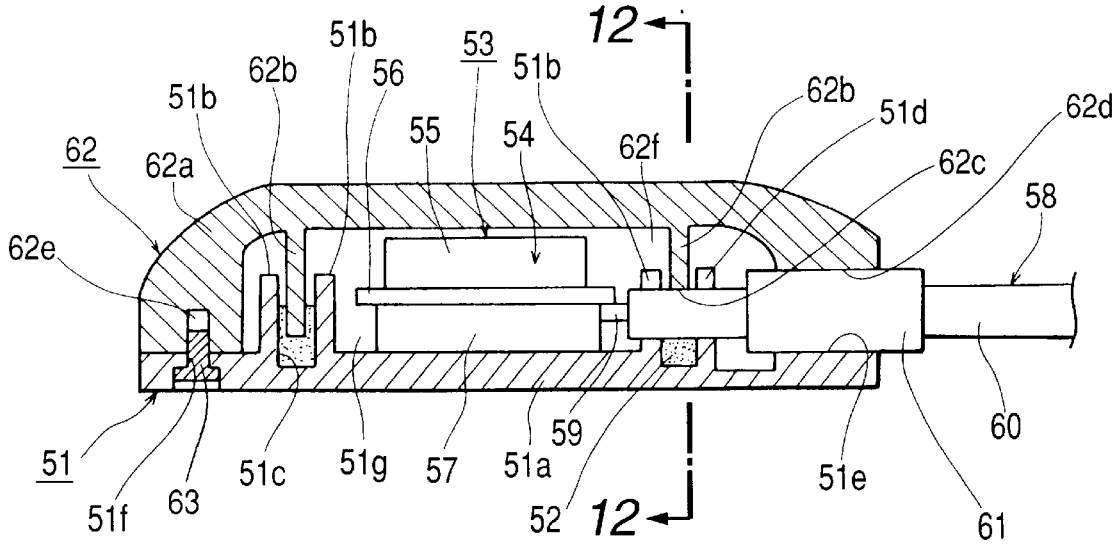
FIG. 10 PRIOR ART
FIG. 10 is a partial cross sectional view in accordance with the conventional waterproof structure of an antenna.
Figure 11:
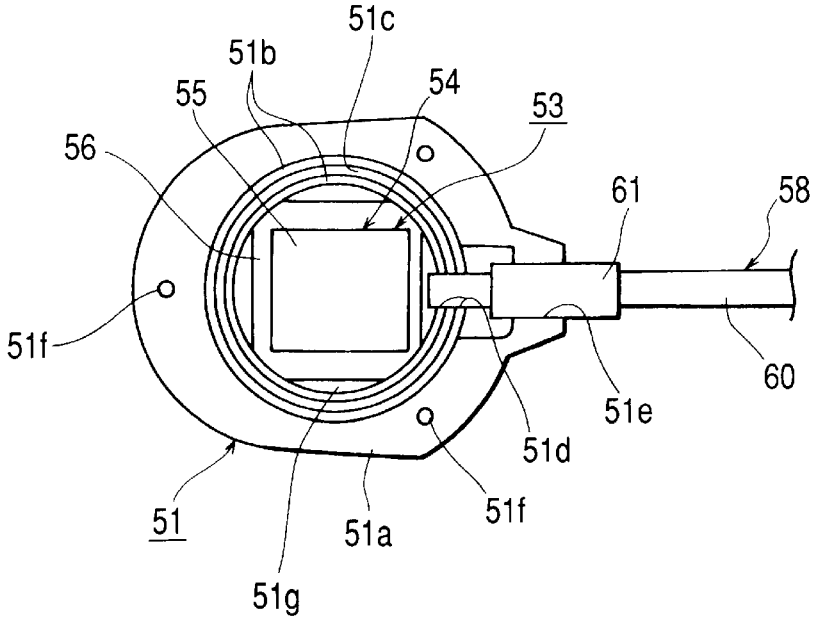
FIG. 11 PRIOR ART
FIG. 11 is a plan view of the conventional waterproof structure of an antenna from which the second case is removed.
Figure 12:
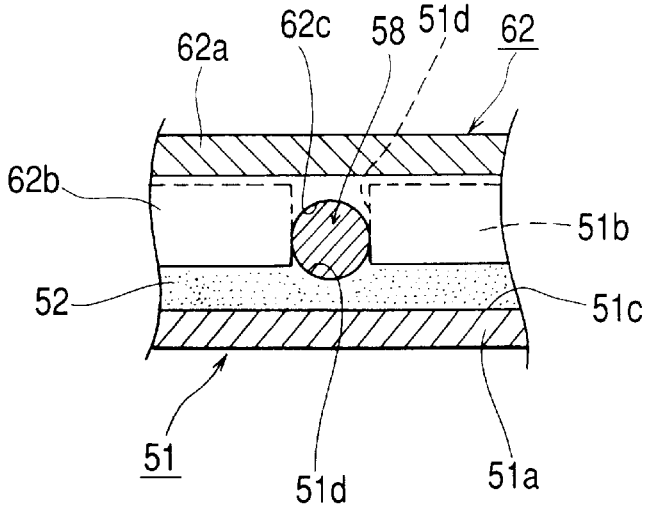
FIG. 12 PRIOR ART
FIG. 12 is partial cross sectional view along the line 12—12 of FIG. 10.
Figure 13:
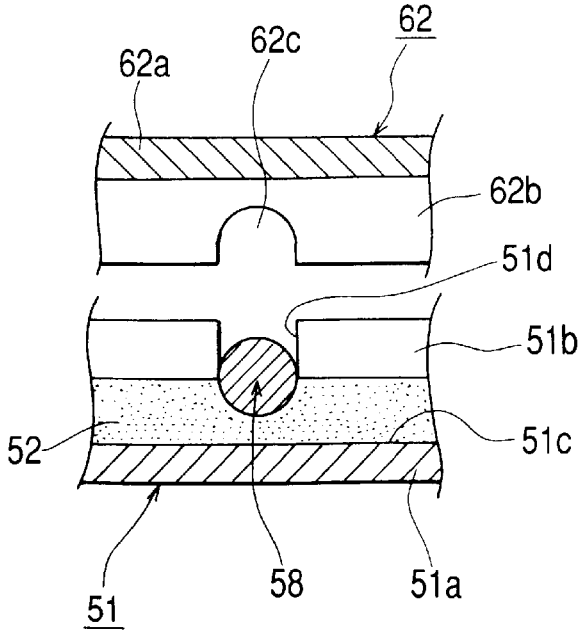
FIG. 13 PRIOR ART
FIG. 13 is an explanatory diagram showing a combination of the first and second cases in accordance with the conventional waterproof structure of an antenna.

The drawings of the waterproof structure of an antenna of the present invention will be described hereunder. FIG. 1 is a plan view showing the waterproof structure of the antenna of the present invention, FIG. 2 is a partial cross sectional view along the line 2—2 of FIG. 1, FIG. 3 is a plan view showing the structure in accordance with the waterproof structure of the antenna of the present invention from which a second case is removed, FIG. 4 is a partial cross sectional view along the line 4—4 of FIG. 2, FIG. 5 is a plan view showing the first case in accordance with the waterproof structure of the antenna of the present invention, FIG. 6 is a partial cross sectional view along the line 6—6 of FIG. 5, FIG. 7 is a bottom view of a second case in accordance with the waterproof structure of the antenna of the present invention, FIG. 8 is a partial cross sectional view along the line 8—8 of FIG. 7, and FIG. 9 is an explanatory diagram showing a method for combining the first and second cases in accordance with the waterproof structure of the antenna of the present invention.

Next, components of the waterproof structure of the antenna of the present invention will be described with reference to FIG. 1 to FIG. 9 hereinafter. As shown particularly in FIG. 5 and FIG. 6, a first case 1 comprising a mold product consisting of synthetic resin that is served as an under case comprises a flat bottom wall 1*a*, two circular ring projection walls 1*b* having different diameters that project upward from the bottom wall 1*a*, a circular ring recess 1*c* formed between the two projection walls 1*b*, and a pair of first notches 1*d* formed on the two projection walls 1*b* at the position opposing each other with interposition of the recess 1*c*.

The first case 1 comprises a circular recess holder 1*e* formed at the position opposing to the first notch 1*d*, a plurality of mounting holes 1*f* formed on the bottom wall 1*a*, and a recess container 1*g* formed at the center position of the projection wall 1*b*.

Furthermore, the adhesive 2 is filled in the recess 1*c,* and contained in the recess 1*c*.

An antenna 3 comprises an antenna body 4 and a coaxial cable 8. The antenna body 4 comprises a rectangular parallelepiped antenna 5, a printed board 6 with a printed wiring pattern (not shown in the drawing) that is served for mounting the antenna 5, and a box shield member 7 comprising a metal plate attached to the printed board 6.

A circular cable 8 comprises a sheath 10 consisting of insulating material such as rubber that cover a core wire 9 and a winding 11 consisting of insulating material that is wound partially on the sheath 10. The core wire 9 of the cable 8 is connected to the wiring pattern of the printed board 6 by means of soldering.

In the antenna 3 having the structure as described hereinabove, the antenna body 4 is contained in the container 1*g,* the cable 8 crosses the recess 1*c* and is placed in the first notch 1*d,* and the winding 11 is positioned on the holder 1*e*.

Furthermore, the width of the first notch 1*d* is formed so as to be approximately equal to the diameter of the cable 8, and therefore when the cable 8 is inserted into the first notch 1*d,* the sheath 10 of the cable 8 is inserted with pressure into and tightly pressed on the first notch 1*d,* and the sheath 10 of the cable 8 is tightly pressed on the bottom of the first notch 1*d*.

Furthermore, when the cable 8 is inserted with pressure into the first notch 1*d,* the lower portion of the cable 8 is positioned in the adhesive 2 contained in the recess 1*c,* and around the bottom half of the cable 8, the space between the first notch 1*d* and the cable 8 is sealed with the adhesive 2 and the bottom half of the cable 8 is sealed by pressing the sheath 10 of the cable 8 with pressure on the inside wall of the first notch 1*d*. Thereby, the container 1*g* is sealed on the lead out side of the cable 8 of the first case 1 side.

As shown particularly in FIG. 7 and FIG. 8, the second case 12 that comprises a mold product consisting of synthetic resin that is served as an upper case comprises a bowl-shaped top wall 12*a* having the same peripheral configuration as that of the bottom wall 1*a*, a circular ring projection 12*b* that projects downward from the top wall 12*a,* a second notch 12*c* formed on the projection 12*b* positioned so as to oppose to the first notch 1*d,* a circular recess holder 12*d* formed at the position so as to oppose to the second notch 12*c,* a plurality of mounting holes 12*e* formed on the top wall 12*a* at the positions to the mounting holes 1*f,* and a recess container 12*f* positioned at the center of the projection 12*b*.

Furthermore, the width of the open end top 12*g* of the second notch 12*c* formed on the second case 12 is larger than the diameter of the cable 8 and the second notch 12*c* has an inclination 12*j* formed so that the width of the second notch 12*c* becomes wider from the top 12*h* of the second notch 12 toward the open end top 12*g*.

The second case 12 is fitted combinedly to the first case 1 so as to cover over the antenna body 4, and a plurality of screws 13 are inserted and screwed from the mounting holes 1*f* side of the first case 1 into the mounting holes 12*e* of the second case 12 to thereby combine the first case 1 with the second case 12.

When the first and second cases 1 and 12 are combined, the winding 11 of the sheath 10 of the cable 8 is held with the holders 1*e* and 12*d,* the projection 12*b* is inserted into the recess 1*c,* and the top end of the projection 12*b* is embedded into the adhesive 2.

In other words, top end of the projection 12*b* excepting the portion that is positioned at the second notch 12*c* is embedded in the adhesive 2.

Furthermore, when these cases 1 and 12 are combined, the cable 8 is positioned in the second notch 12*c,* the top 12*h* of the second notch 12*c* presses the sheath 10 onto the first notch 1*d* side, the adhesive 2 is filled in the space between the cable 8 and the second notch 12*c* and the space is sealed with the adhesive 2. Thereby, the container 12*f* is sealed on the lead-out side of the cable 8 of the second case 12 side.

At that time, the adhesive 2 is filled in the space between the top 12*h* and the cable 8 and the space is sealed.

In other words, on the lead-out side of the cable 8 of the first case 1, the bottom half of the cable 8 is inserted with pressure into and tightly pressed on the first notch 1*d* and the space between the cable 8 and the first notch 1*d* is sealed with the adhesive 2. On the other hand, on the lead-in side of the cable 8 of the second case 12, the space between the top half of the cable 8 and the second notch 12*c* is sealed with the adhesive 2. Thereby, the containers 1*g* and 12*f* are sealed, and the surrounding of the containers 1*g* and 12*f* is sealed by embedding the projection 12*b* in the adhesive 2. As the result, the antenna body 4 is waterproofed.

Next, a method for combining the first and second cases 1 and 12 will be described with reference to FIG. 9. As shown in FIG. 9, the second case 12 covers the first case 1 so that the second notch 12*c* is fitted to the cable 8 in the state that the cable 8 has been inserted with pressure into the first notch 1*d* of the first case 1.

At that time, the top end of the projection 12*b* of the second case 12 is embedded in the adhesive 2 in the state that the cable 8 is positioned in the second notch 12*c*.

The surface of the adhesive 2 moves upward concomitantly with embedding of the projection 12*b,* and the adhesive 2 penetrates from the open end top 12*g* to the second notch 12*c* concomitantly with the upward motion of the surface of the adhesive 2 and penetrates to be filled in the whole space between the cable 8 and the second notch 12*c*. The top 12*h* of the second notch 12*c* presses on the sheath 10 of the cable 8, and the sheath 10 is pressed on the bottom of the first notch 1*d*. Thereby, the combination of the first and second cases 1 and 12 is completed.

When the first and second cases 1 and 12 are combined, because the width of the open end top 12*g* is larger than the diameter of the cable 8, the adhesive 2 penetrates into the second notch 12*c* easily, and penetrates into the top 12*h* securely with aid of the inclination 12*j*.

Thereby, the space between the top half of the cable 8 and the second notch 12*c* can be sealed securely with the adhesive 2.

The space between the bottom half of the cable 8 and the first notch 1*d* is sealed with the adhesive 2 by embedding the bottom half of the cable 8 in the adhesive 2, and the surrounding of the containers 1*g* and 12*f* is sealed by embedding the projection 12*b* in the adhesive 2. As the result, the containers 1*g* and 12*f* are sealed securely and reliable waterproofing is obtained.

Furthermore, regardless of variation of the width of the second notch 12*c* caused when the second case 12 is fabricated or variation of the diameter of the cable 8, the adhesive 2 penetrates into the second notch 12*c* to seal the space.

Though V-shaped second notch 12*c* is described in the abovementioned embodiment, another configuration such as U-shape may be employed.

Furthermore, though the case in which the adhesive 2 is interposed between the top 12*h* and the cable 8 is described, the cable 8 may be pressed strongly on the top 12*h*.

Furthermore, though the circular ring recess 1*d* and projection 12*b* are described, elliptic or polygonal ring recess and projection may be employed.

In the waterproof structure of an antenna of the present invention, the width of the open end top 12*g* of the second notch 12*c* provided on the projection 12*b* of the second case 12 is formed so as to be wider than the diameter, the cable 8 that crosses the recess 1*c* of the first case 1 is placed in the first notch 1*d*, and the projection 12*b* that projects into the recess 1*c* allows the adhesive 2 to penetrate in the second notch 12*c* and the adhesive 2 seals the space between the cable 8 and the second notch 12*c* to thereby seal the containers 1*g* and 12*f*. As the result, the space between the top half of the cable 8 and the second notch 12*c* is sealed securely with the adhesive 2, the containers 1*g* and 12*f* are sealed securely, and reliable waterproofing is realized.

Furthermore, by employing the structure as described hereinabove, the adhesive 2 penetrates securely in the second notch 12*c* and reliable waterproofing is realized regardless of variation of the second notch 12*c* in manufacturing unlike conventional waterproofing in which the adhesive does not penetrate in the notch.

Furthermore, the simple waterproof structure can be realized at high productivity only by forming the width of the open end top 12*g* of the second notch 12*c* so as to be larger than the diameter of the cable 8.

Furthermore, because the width of the first notch 1*d* is formed so as to be approximately equal to the diameter of the cable 8, the bottom half of the cable 8 on the lead-out side of the cable 8 of the first case 1 can be inserted into with pressure and tightly pressed on the first notch 1*d*, and the adhesive 2 seals the space between the cable 8 and the first notch id to thereby realize reliable waterproofing.

Furthermore, the recess 1*c* is formed in the ring shape, the projection 12*b* is formed in the ring shape, the top end of the projection 12*b* excepting a portion positioned at the second notch 12*c* is embedded in the adhesive 2, and the containers 1*g* and 12*f* are sealed. As the result, the surrounding of the containers 1*g* and 12*f* is sealed by embedding the projection 12*b* in the adhesive 2, and the containers 1*g* and 12*f* are sealed securely and reliable waterproofing is realized.

Furthermore, the cable 8 is positioned at the top 12*h* of the second notch 12*c*, the space between the second notch 12*c* including the top 12*h* and the cable 8 is sealed with the adhesive 2, and the space between the top half of the cable 8 and the second notch 12*c* is sealed securely with the adhesive 2. Thereby, the containers 1*g* and 12*f* are sealed more securely, and reliable waterproofing is realized.

Furthermore, because the inclination 12*j* formed so that the width of the second notch 12*c* is larger from the top 12*h* toward the open end top 12*g* is provided, the adhesive 2 can penetrate into the second notch 12*c* easily, and the inclination 12*j* allows the adhesive 2 to penetrate securely into the top 12*h*.

What is claimed is:

1. A waterproof structure of an antenna comprising:

first and second cases;

an antenna body contained in containers comprising the first and second cases; and a cable that is lead to an outside of the first and second cases, wherein the first case has a recess to contain an adhesive and a first notch in which the cable is disposed to cross the recess, wherein the second case has a projection that projects into the recess and a second notch disposed on the projection and positioned to oppose to the first notch to position the cable, wherein the cable is positioned at a top of the second notch and the second notch is provided with an inclination formed so that a width of the second notch becomes wider from the top toward a open end top, wherein the cable that crosses the recess is placed in the first notch, and wherein the projection that projects into the recess allows the adhesive to penetrate into the second notch to thereby seal a space between the second notch including the top and the cable with the adhesive.

2. The waterproof structure of an antenna according to claim 1, wherein a width of the first notch is approximately equal to the diameter of the cable.

3. The waterproof structure of an antenna according to claim 1, wherein the recess is formed in ring-shape, wherein the projection is formed in ring-shape, wherein a top end of the projection excepting a portion positioned at the second notch is embedded in the adhesive and wherein the containers are sealed thereby.

* * * * *